US012121954B2

(12) United States Patent
Gianferrara et al.

(10) Patent No.: US 12,121,954 B2
(45) Date of Patent: Oct. 22, 2024

(54) SETTING TOOL FOR BLIND FASTENERS

(71) Applicant: NEWFREY LLC, New Britain, CT (US)

(72) Inventors: Paul Gianferrara, Giessen (DE); Manuel Schneider, Giessen (DE); Luis Rodrigo, Giessen (DE); Christof Clemen, Giessen (DE)

(73) Assignee: NEWFREY LLC, New Britain, CT (US)

( * ) Notice: Subject to any disclaimer, the term of this patent is extended or adjusted under 35 U.S.C. 154(b) by 0 days.

(21) Appl. No.: 18/451,369

(22) Filed: Aug. 17, 2023

(65) Prior Publication Data

US 2023/0390822 A1 Dec. 7, 2023

Related U.S. Application Data

(60) Division of application No. 17/457,592, filed on Dec. 3, 2021, now Pat. No. 11,738,384, which is a (Continued)

(30) Foreign Application Priority Data

Jun. 5, 2019 (WO) ..... PCT/EP2019/064680

(51) Int. Cl.
*B21J 15/26* (2006.01)
*B21J 15/32* (2006.01)

(52) U.S. Cl.
CPC ..... *B21J 15/26* (2013.01); *B21J 15/32* (2013.01)

(58) Field of Classification Search
CPC ... B25J 15/16; B25J 15/26; B25J 15/32; B25J 15/10; B27F 7/11; B27F 7/13; B27F 7/36; B27F 7/38; B25C 1/06; B25C 5/15
See application file for complete search history.

(56) References Cited

U.S. PATENT DOCUMENTS

2016/0114383 A1 4/2016 Honsel

FOREIGN PATENT DOCUMENTS

AU 689457 B2 4/1998
CN 105263678 B 12/2018
(Continued)

OTHER PUBLICATIONS

JP Office Action Dated Mar. 18, 2024, cited in corresponding Japanese Application No. 2021-567029.
(Continued)

*Primary Examiner* — Christopher J. Besler
(74) *Attorney, Agent, or Firm* — Michael P. Leary

(57) ABSTRACT

A method for setting a blind fastener comprising the steps of: providing a workpiece with a through hole; providing the fastener; providing a setting tool comprising: a tool housing; a screw tool with a male thread movable within the housing along and around a tool axis between a retracted and an extended positions; a first electric motor with a first drive shaft axially fixed to the tool housing, the first drive shaft defining a first axis radially spaced from the tool axis; a second electric motor with a second drive shaft axially fixed to the tool housing, the second drive shaft defining a second axis radially spaced from the tool axis and from the first axis; and a solid roller screw arranged for rotation and axial movement in the tool housing, and axially concentric with and in driving connection to the screw tool; supplying the fastener in front of the screw tool when the screw tool is in the retracted position; engaging the screw tool with the fastener; and setting the fastener to the workpiece.

9 Claims, 14 Drawing Sheets

Related U.S. Application Data continuation of application No. PCT/EP2020/065546, filed on Jun. 4, 2020.

(56) References Cited

FOREIGN PATENT DOCUMENTS

| | | | |
|---|---|---|---|
| DE | 3341602 | A1 | 5/1984 |
| EP | 3141316 | B1 | 3/2018 |
| GB | 2212431 | A | 7/1989 |
| JP | H01166846 | A | 6/1989 |
| JP | H08505089 | A | 6/1996 |
| WO | 1994015736 | A | 7/1994 |
| WO | 1994015736 | A1 | 7/1994 |

OTHER PUBLICATIONS

International Search Report Dated Oct. 19, 2020 cited in corresponding PCT Application No. PCT/EP2020/065546.
Chinese Office Action dated Sep. 21, 2023 cited in corresponding Chinese Application No. 202080037876.7.

SETTING TOOL FOR BLIND FASTENERS

CROSS-REFERENCE TO RELATED APPLICATIONS

This application is a divisional of U.S. patent application Ser. No. 17/457,592, filed Dec. 3, 2021, which is a continuation of international application PCT/EP2020/065546, filed Jun. 4, 2020, which claims priority from international application PCT/EP2019/064680, filed Jun. 5, 2019, the disclosures of which are incorporated herein by reference in their entirety.

BACKGROUND OF THE INVENTION

The present invention is directed to a setting tool for setting a blind fastener or blind element in a workpiece.

In motor vehicle manufacture it is usual that various components such as strips, rails, equipment etc. are fastened to thin-walled components, such as sheet metal or profiles of aluminium, for example. A common method of connecting components is to use a fastener having a screw thread.

Blind fasteners are fastening elements that are to be arranged in an opening, for example, in a through hole of a metal sheet or any other sheet or workpiece. They are commonly used to secure a plurality of work pieces together when it is difficult or impossible to access the blind side of one of the work pieces. Blind fasteners have generally incorporated a sleeve or shank that expands and bends during installation. A blind fastener can be a blind rivet, a blind rivet nut, a self-drilling self-tapping screw, or similar fasteners. A blind fastener can provide an internal thread and thus render possible a screw connection to metal sheets or workpieces, the wall thickness of which is not sufficient to embody a thread.

A blind fastener setting device or setting tool for blind fasteners is used to automatically set the blind fastener in the opening of the workpiece. The blind fastener has, in a non-deformed state, a hollow cylindrical rivet shank at the one end of which a radially extending set head is embodied and on the other end of which an internal thread is formed (for instance for a blind rivet nut) and/or a mandrel may be arranged (for example for a blind rivet). It is known to use a bolt having an external thread cooperating with the internal thread of the blind rivet nut to set the blind rivet nut in the hole. The internal thread of the blind rivet nut engages with the external thread of the bolt.

The blind fastener is inserted with the rivet shank first into the hole until the rivet head contacts the sheet. By start-up of the blind fastener setting device, the bolt or the mandrel and thus the thread region are then moved axially backwards from the blind fastener and the sheet, whereby a compression of the rivet shank occurs. A bead or a bulge is formed at a desired deformation point at the workpiece side facing away from the rivet head. The blind fastener is thus held captively in the hole (or opening).

To remove the setting device from the set blind fastener, pressure on the bolt is relieved and it is rotated in the drill-off direction. The blind fastener setting device is then available for a new setting operation.

Document EP0886733 for instance discloses a setting device for blind rivet nuts comprising a first actuator adapted to guide along a longitudinal axis the blind rivet nut and a second actuator adapted to rotate the bolt or threaded insert, notably to remove the bolt from the blind rivet nut after the setting step (in other words after the crimping of the blind rivet nut).

Document U.S. Pat. No. 7,346,970 discloses a setting device for blind fasteners having a single electric motor with a drive shaft that is positioned in a first housing part and is connected via a transmission means to a tool housing part. The tool housing part is laterally offset relative to the drive shaft and extends in parallel with the drive shaft. A tool shaft is arranged in the tool housing part and has non-rotationally connected thereto a screw type tool which projects from the front end of the tool housing part. Locking means to which the tool housing part and the tool shaft can be coupled together in non-rotational fashion, or decoupled, anti-rotation means with which the tool shaft can be blocked against rotation or can be released for rotation are also provided.

US2016114383 discloses a riveting device for setting a blind rivet element which includes a mandrel, a first motor comprising a first operative connection to the mandrel, and a second motor comprising a second operative connection to the mandrel. The mandrel is configured to have a rotational movement be transmitted thereto to screw the mandrel into the blind rivet element, and to be retracted into the riveting device by a retraction movement to produce an at least partial plastic deformation of the blind rivet element. The first motor transmits the rotational movement to the mandrel via the first operative connection. The second motor transmits the retraction movement to the mandrel via the second operative connection. Such arrangement may be heavy and may not provide the flexibility needed.

DE3341602 discloses an apparatus for installing threaded fasteners by contracting them axially to radially expand them is of the type including an anvil against which a fastener is compressed by a threaded mandrel which is rotated by an air driven motor. The device does not allow an automatic setting of the blind fastener.

Such setting tools may be cumbersome and needs a minimum time to perform all the steps and motions needed to perform the crimping and then become available for the next setting operation. The setting of blind fasteners is often burdensome, since several steps are necessary to catch the blind fastener and to orient it correctly. Besides, the forces and motions needed to engage such blind fasteners mostly imply complicated system which cannot be compact in view of the forces needed.

BRIEF SUMMARY OF THE INVENTION

It is hence an object of the present invention to at least alleviate the aforementioned shortcomings. More particularly one objective of the present invention is to provide a blind fastener setting device which is of a simple design, compact, reliable and allowing a fast setting of blind fasteners in order to cut down on production time.

To this aim, according to the invention, it is provided a blind fastener setting device according to claim 1.

Such setting tool can be fully automated. The delivery of the blind fastener is directly integrated to the tool, such that the setting time is reduced, and no additional delivery mechanism are necessary. The presence of the two motors allows an exact control of the position and the load applicable during the setting process, such that the parameter of the joining can be exactly controlled and adapted to the different blind fasteners or workpieces to be joined. The first, second and tool housing portions facilitates maintenance operations.

According to an embodiment, the tool housing portion comprises a solid roller screw connected to the tool shaft, wherein a shaft gear with an anti-rotation sleeve is arranged around the solid roller screw, said shaft gear being connected to the second electric motor through a second housing gear. The tool housing portion is robust and allows the presence of load cells if necessary. The solid roller screw allows a good guiding of the tool shaft along its joining axis.

According to an embodiment, the solid roller screw connected to the tool shaft comprises a first end connected to the tool shaft and a second end, opposite the first end, and wherein an anti-rotation hub of the solid roller screw is arranged at the second end.

According to an embodiment, the second housing portion comprises the second electric motor with the second drive shaft and the second housing gear, wherein the first housing portion comprises the first electric motor and a first housing gear, said first housing gear is connected to a tool gear. The tool gear is arranged within the tool housing portion and is fixedly connected to a roller screw nut arranged around the solid roller screw.

According to an embodiment, the spinning of the first drive shaft creates a linear motion of the solid roller screw. The first transmission device, when controlled alone creates a translation of the solid roller screw and thus of the tool shaft and the screw tool.

According to an embodiment, the spinning of the first and second drive shaft at different speeds creates a linear and rotational motion of the screw tool, such that the screw tool can engage a blind fastener. Both motors act together to allow the translation and the rotation of the screw tool. This arrangement ensures a robust connection and an exactly controlled reaction of the screw tools through both motors. The load and setting forces can be controlled through the two motors.

According to an embodiment, the delivery tube extends parallel or sensibly parallel to the tool housing portion, and wherein the interface channel comprises a first portion which is coaxial with the delivery tube and a portion which is align with the longitudinal axis, such that the interface channel is adapted to deliver the blind fastener within the tool housing portion. The tool is thus compact and adapted to be used in industrial environments.

According to an embodiment, a clamping device adapted to clamp a blind fastener for its engagement with the screw tool is provided, and wherein the clamping device is arranged within the tool housing portion. The clamping device retains the nut within the tool housing portion, such that the engagement with the screw tool is realized in line inside the setting tool. This reduces the setting time.

According to an embodiment, the clamping device comprises two movable jaws adapted to clamp the blind fastener. The two movable jaws allow a centered or off-centered clamping and an adaptation of the clamping forces to the nut if necessary. Besides, an off-centered clamping allows a better clamping of nuts having for instance shanks with a hexagonal cross-section. The movable jaws are forcibly actuated.

According to an embodiment, the clamping device further comprises a retaining lever, such that the blind fastener is retained in the clamping device during the clamping by the jaws. The lever acts as a gate, maintaining the nut in the clamping device such that the jaws can be actuated.

According to an embodiment, each jaw comprises a catching surface comprising a first and a second segment, the first segment being angled with regard to the second segment, and wherein the first segment is flat whereas the second segment comprises a bulge adapted to create a dissymmetrical profile for orienting the blind element within the clamping device.

According to an embodiment, the screw tool is provided with an anvil sleeve adapted to contact the movable jaws.

According to an embodiment, the tool shaft comprises a front segment and a rear segment, wherein an intermediate segment is arranged between the front and the rear segment, and wherein the front segment comprises a first part connected to a flange through a groove.

According to an embodiment, the flange is provided with a plurality of evenly distributed holes adapted to receive screws, and the groove has a multi radii curvature.

The present disclosure is also directed to a method for setting a blind fastener in a workpiece, comprising:

- providing a blind fastener setting device as described above;
- providing a blind fastener comprising a rivet shank with an internal thread and a rivet head;
- feeding the blind fastener in the feeding assembly, such that the blind fastener moves through the feeding channel to the retainer;
- retaining the blind fastener in the retainer such that the blind fastener is in a loading position;
- guiding the screw tool with the first and second transmission devices in a first direction along the longitudinal axis into the blind fastener with the shank and engaging with the internal thread of the blind fastener;
- guiding the blind fastener further in the first direction along the longitudinal axis such as to release the blind fastener from the tool housing portion into a nose and then further outside the nose;
- guiding the blind fastener through a hole of a workpiece until the head contacts the workpiece and at least a portion of the shank extends in the hole;
- deforming the blind fastener through a displacement by the first transmission device in a second direction, opposite the first direction, such as to perform a crimping process of the blind fastener;
- guiding the screw tool with the first and the second transmission device in the second direction along the longitudinal axis to disengage the blind fastener from the screw tool.

Such method is easy to implement and allows a better control of the setting with a reduced setting time. In an embodiment, a torque test may be performed to check the quality of the crimping and/or the quality of the internal thread after the crimping.

According to an embodiment, the torque of the roller screw is monitored, and unexpected torque peaks are avoided by stopping the first motor (36) and releasing the second motor.

BRIEF DESCRIPTION OF THE DRAWINGS

Other characteristics and advantages of the invention will readily appear from the following description of embodiments, provided as non-limitative examples, in reference to the accompanying drawings.

In the drawings.

DETAILED DESCRIPTION OF THE PREFERRED EMBODIMENTS

On the different figures, the same reference signs designate identical or similar elements.

Figure 1:
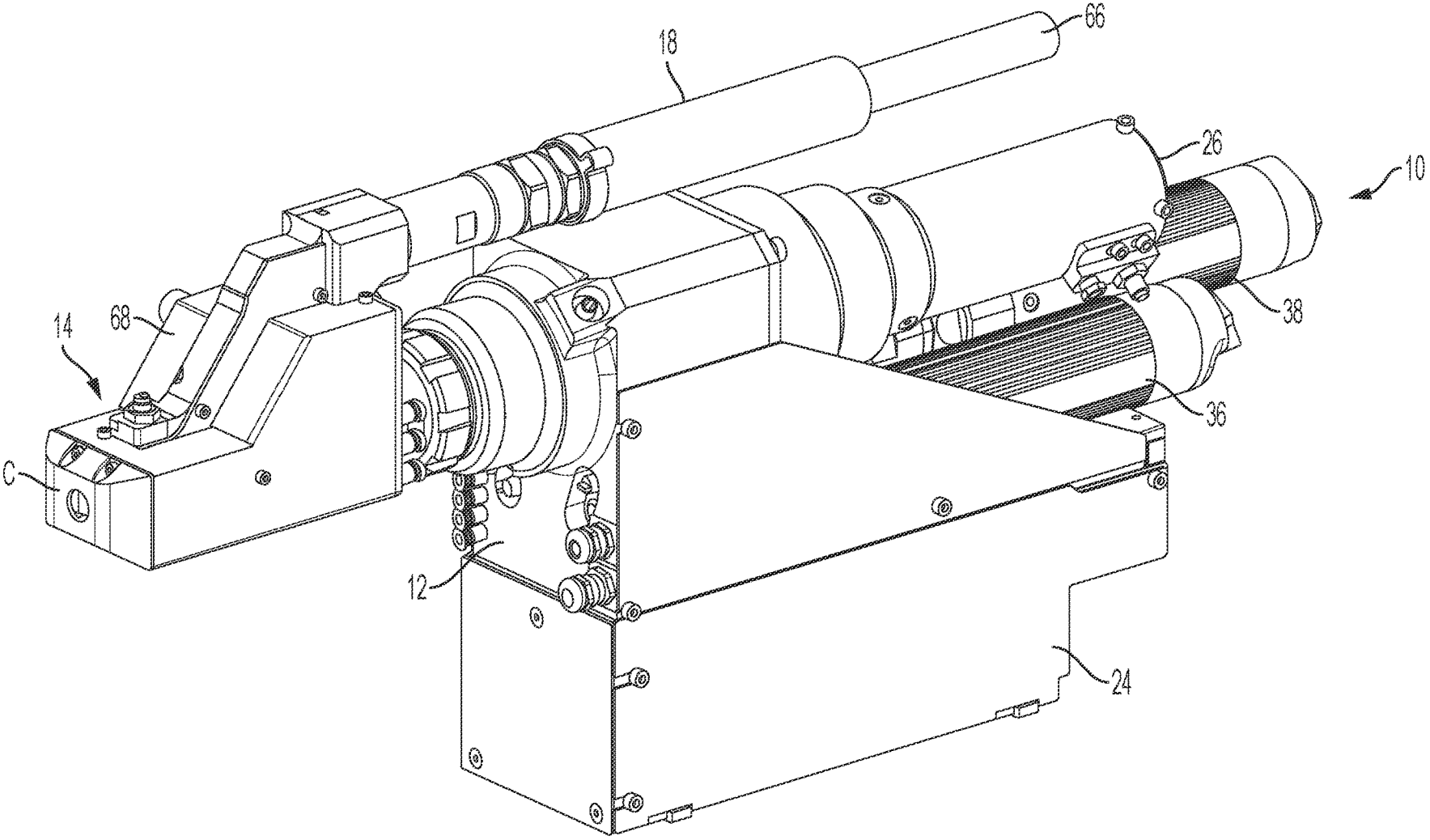
FIG. 1 shows a schematic perspective view of a setting tool for blind fasteners.

FIG. 1 schematically shows a setting tool 10 for blind fasteners or blind elements. As illustrated, the setting tool 10 comprises a housing 12 with different housing portions, a tool nose 14 and a feeder 18 adapted to drive a blind fastener 20 to the tool nose 14 to perform a crimping step.

The housing 12 is adapted to be attached to an arm of a robot through an interface 24. In an embodiment, the housing 12 is fixed to a support through a slide adapted to translate the housing 12. The slide can be actuated by an actuator.

Typically, a blind fastener or blind element or blind rivet nut 20 can comprise a hollow rivet shank 22 with an internal thread and a rivet head 24 outwardly extending from the rivet shank at one end of the shank. The rivet shank 24 is adapted to be arranged in a hole of a workpiece and the rivet head is adapted to contact a surface of the workpiece. The rivet shank 22 is adapted to be deformed by the setting tool such has to form a crimping bulge on the underside of the workpiece.

Figure 2A:
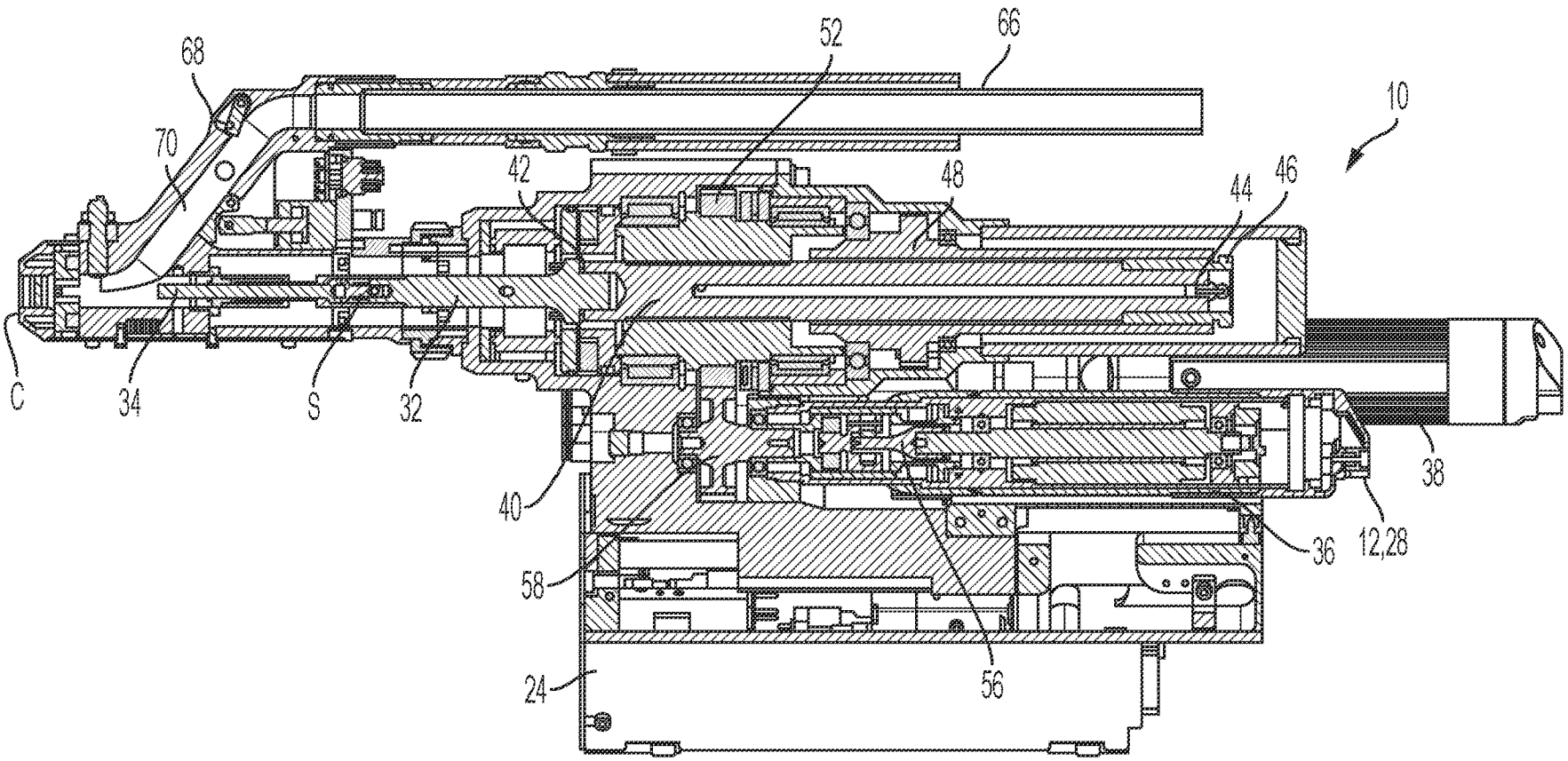
FIG. 2A shows a schematic cross-section of the first transmission assembly and the feeder of the setting tool according to the invention in a first position.
Figure 2B:
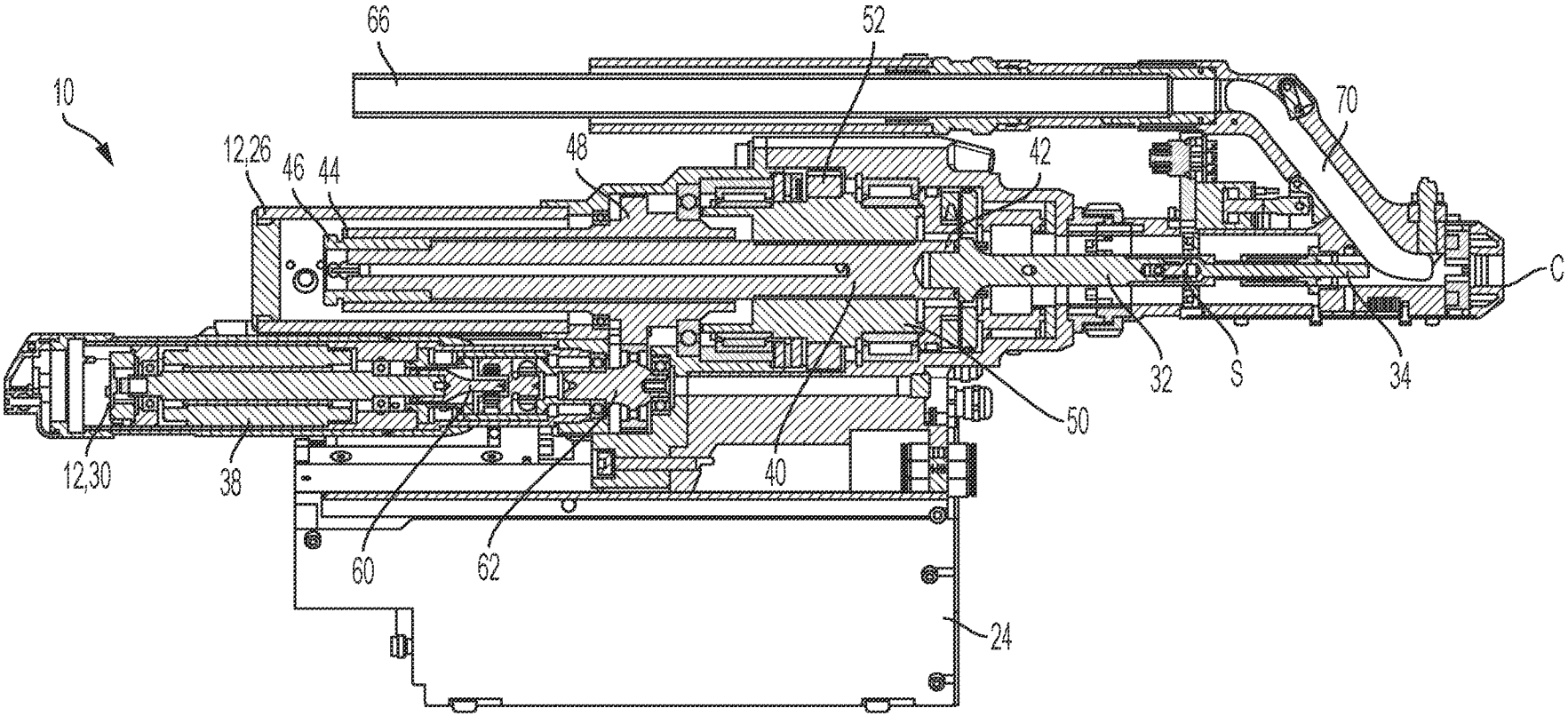
FIG. 2B shows a schematic cross-section of the second transmission assembly and the feeder of the setting tool according to the invention in a first position.
Figure 3A:
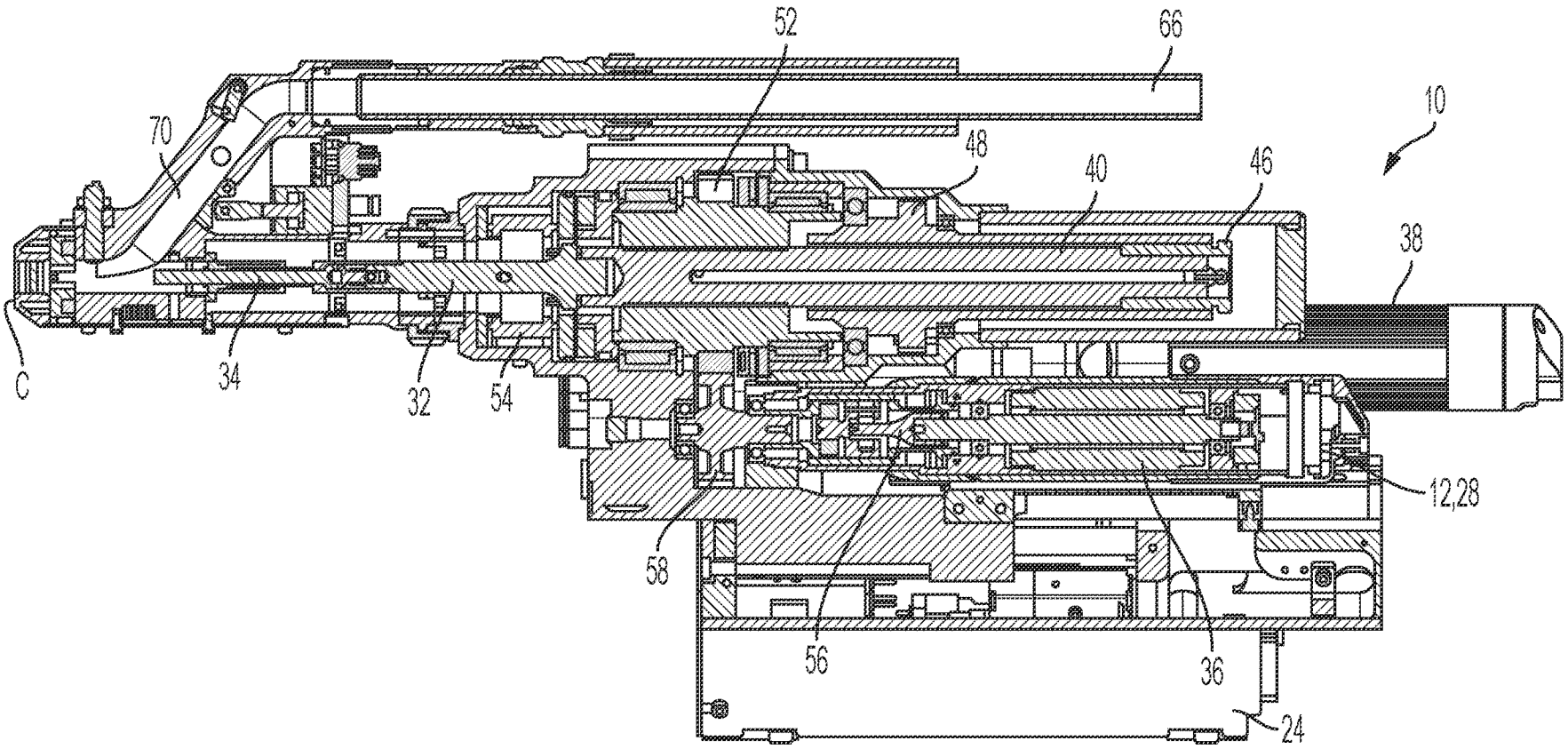
FIG. 3A shows a schematic cross-section of the first transmission assembly and the feeder of the setting tool according to the invention in a second position.
Figure 3B:
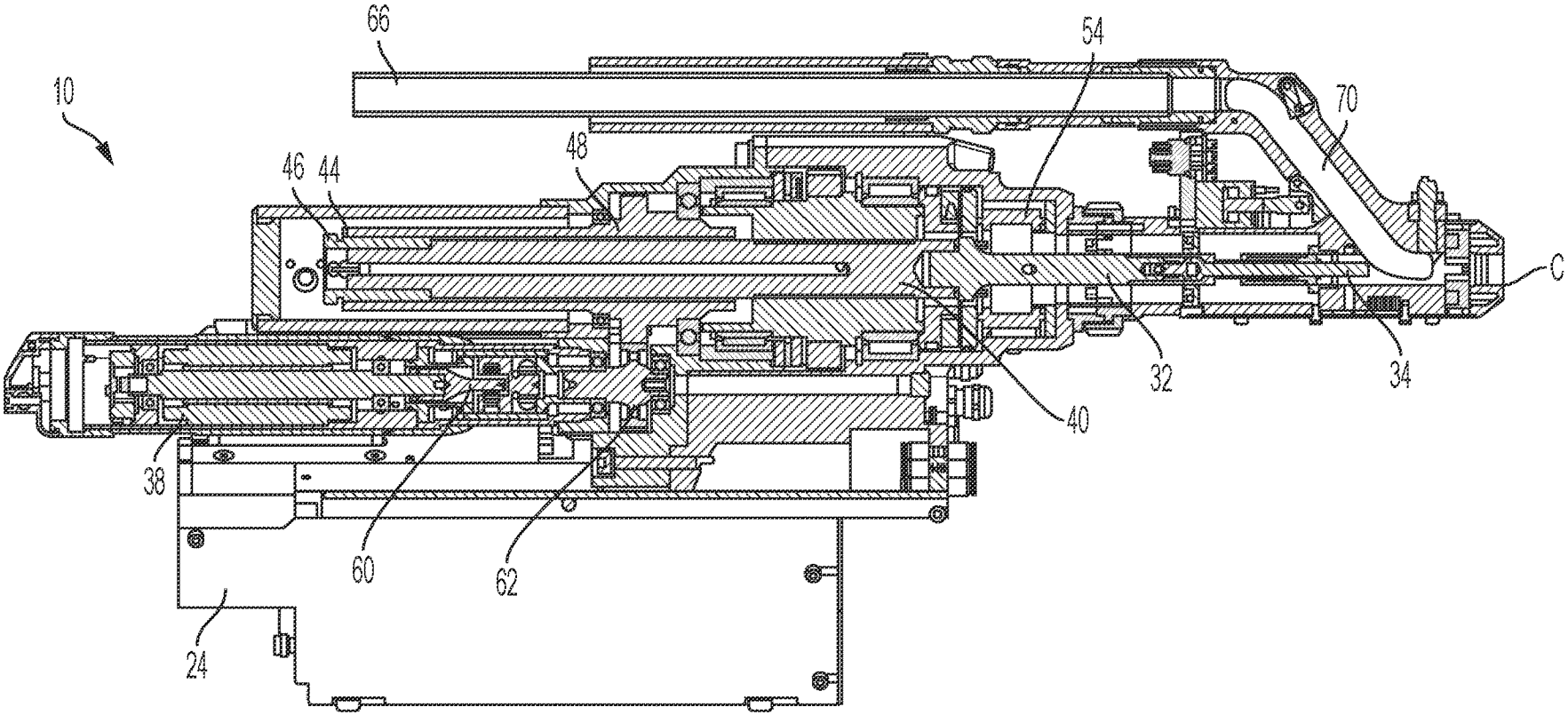
FIG. 3B shows a schematic cross-section of the second transmission assembly and the feeder of the setting tool according to the invention in a second position.

The housing 12 is provided with a tool housing portion 26, a first housing portion 28 and a second housing portion 30, as depicted in FIG. 2 and FIG. 3.

Transmission

The tool housing portion 26 comprises a tool shaft 32 connected to a screw tool 34, the screw tool 34 being adapted to engage with the internal thread of a blind fastener 20. The tool shaft 32 and the tool screw 34 are rotationally and translationally movable through a first and second transmission device which respectively works with a first and second electric motor 36, 38. The tool shaft 32 and the tool screw 34 are rotationally and translationally movable along and around a longitudinal axis X. The tool housing portion 26 further comprises a solid roller screw 40 connected to the tool shaft 32, and more particularly fixedly assembled to the tool shaft such that a rotation or a translation of the solid roller screw 40 may be transferred to the tool shaft 32. A washer is arranged between the roller screw and the tool shaft.

An anvil sleeve 140 can be provided around the screw tool and can be elastically moved along the screw tool. A tool sleeve 150 may also be arranged around the screw tool and a gap G may be provided between the anvil sleeve and the tool sleeve.

Figure 13:
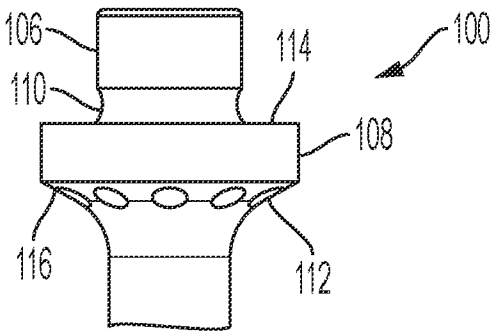
FIG. 13 is a side view of the head of the tool shaft of FIG. 11.
Figure 12:
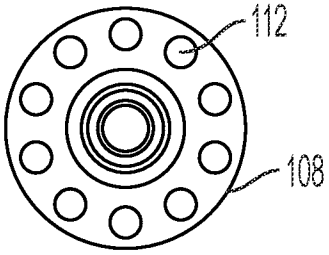
FIG. 12 is a detailed top view of the head of the tool shaft of FIG. 11.
Figure 11:
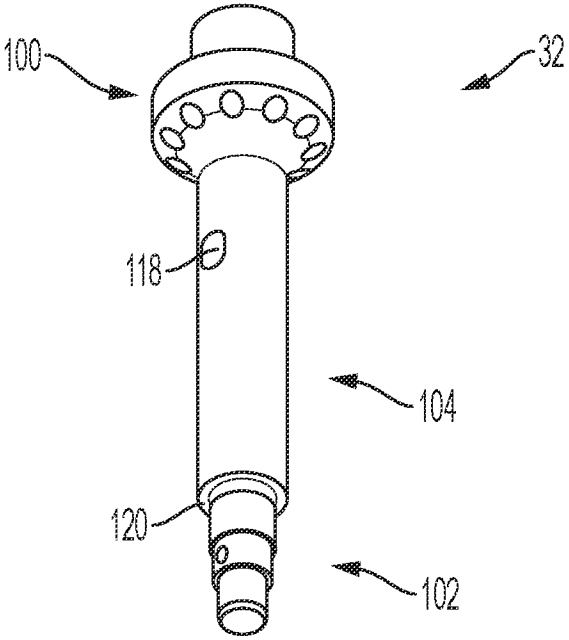
FIG. 11 is a detailed view of a tool shaft of the setting tool for blind fasteners.

The tool shaft 32 is more particularly depicted in FIGS. 11, 12 and 13. As represented in FIG. 11, the tool shaft 32 is a jack bolt adapted to reduce stress loads in rods and tie bars. The design of the tool shaft 32 enables in particular to resist to high cycle fatigue with a compact element adapted to be arranged in restricted area, where more material to carry the load cannot be used. Thus, the present tool shaft 32 is particularly compact. The tool shaft comprises a front segment 100 and a rear segment 102. An intermediate segment 104 is arranged between the front and the rear segment 100, 102. The tool shaft 32 extends longitudinally and is sensibly a cylindrical element.

The front segment comprises a first part 106 defining a free end and a flange 108 connected to the first part. The first part is threaded. For instance, the thread is M16*0.5, same as in the roller screw. The front part is shown in more details in FIG. 13. The first part 106 is cylindrical and has a constant cross section. The cross section is for instance of 15.2 mm. It extends longitudinally and comprises a chamfer at its free end. For instance, the chamfer may be of 45 degrees. The first part 106 is connected to the flange through a groove 110. The groove 110 may be realised with several radii, such that the connection between the flange 108 and the first part 106 allows a better repartition of the forces when a high load is applied on the tool shaft 32. For example, the groove has a first radius of 2.5 mm in the vicinity of the first part 106 and the radius first increase to a 3 mm radius before it decreases up to 1 mm in the vicinity of the flange 108. In other words, the groove is designed with multiple chained radii, combined with tangential outlines. The particular dimensioning and curvature of the groove allows an adequate repartition of the forces for the present tool. The flange 108 comprises a section with a constant circular cross-section. The cross-section of the flange 108 is larger than the cross-section of the first part 106. A plurality of holes 112 adapted to receive screws (more particularly jack bolts or compressive jack bolts) for fixation are regularly arranged on the flange (see FIG. 12). For instance, ten similar holes are arranged on the flange at 36 degrees from each other. The number of holes is particularly advantageous, since it allows a pre-stressing. Pre-stressing that is equally distributed around the circumference of the flange. The high number of jack bolts allows for applying the pre-stress without a high torque. Pre-stress is needed to keep the joint formed with the tool shaft firmly connected and to optimize lifetime. When external load is applied, the compressive pre-stress will be balanced out of the joint, thus reducing the additional stress to the minimum. The transition allows for a maximum of material around the screw holes, which helps to take up and distribute high stresses from the jack bolts and reduce them henceforth. Gradual transitions from thicker to thinner diameters help to distribute occurring stresses in the most optimal way. Such design allows an increase of the lifetime while keeping a compact tool, notably the tool shaft has thus a maximal diameter of 30 mm. The flange 108 comprises an upper surface 114 directed to the first part 106 and a lower surface 116 facing the intermediate segment 104. The washer is disposed in contact with the upper surface 114. The washer is made of hardened material and form an interface between the tool shaft 32 and the roller screw 40. The lower surface has a curvature, as visible in FIG. 13. The curvature radius may be of 7 mm. For instance, the lower surface form an angle with the lateral surface of the flange of 60 degrees.

The intermediate segment 104 has a constant cross-section. For example, the diameter of the intermediate section is 13.5 mm. The intermediate section longitudinally extends and may be provided on a portion of its longitudinal length with a channel. A channel aperture 118 is visible on the lateral side of the intermediate segment. Between the intermediate segment 104 and the rear segment, a groove 120 is provided. The rear segment 102 comprises three portions, each having a different diameter and a constant cross-section. More particularly, the diameter of the portions decreases, such that the portion of the free end of the rear segment has the smallest diameter. A second aperture for the channel is provided in the middle portion of the rear segment 102.

The design of the tool shaft thus allows a compact element (with a maximal diameter of 30 mm) adapted to support external load up to 35 kNewtons.

The solid roller screw 40 comprises a first end 42 adapted to be fixed to the tool shaft and a second end 44 opposite the first end. The tool shaft 32 and the screw tool 34 may be part of a load pin assembly.

An anti-rotation hub 46 of the solid roller screw may be arranged at the second end 44. The solid roller screw 40 comprises a first segment in the vicinity of the second end 44 and a second segment in the vicinity of the first end 42. A shaft gear with an anti-rotation sleeve 48 is arranged around the first segment of the solid roller screw 40. A roller screw nut 50 is arranged around the second segment of the solid roller screw 40 and interacts with said solid roller screw. A tool gear 52 is fixedly connected to the roller screw nut 50. The tool housing portion 26 may also be provided with load cells 54 adapted to determine the load applied to the blind fastener 20 during the setting step (or more particularly during the crimping step). The load cell gives the compressing force. Therefore, through the load cells 54 it is possible to read the load applied to set the nut during the crimping. When a pre-determined load is reached, the crimping is properly done and then the motor can shut down.

The first housing portion 28 is provided with the first electric motor 36 with a first drive shaft 56 and a first housing gear 58 connected to the first drive shaft 56.

The second housing portion 30 is provided with the second electric motor 38 with a second drive shaft 60 connected to a second housing gear 62.

The first housing portion 28 may extend longitudinally in a direction parallel to the longitudinal direction of the second housing portion 30 and/or the tool housing portion 26. The second housing portion 30 may extend longitudinally in a direction parallel to the longitudinal direction of the tool housing portion. More particularly, the tool housing portion 26 may extend longitudinally around the longitudinal axis X and the first and second housing portions longitudinally extends sensibly parallel to the longitudinal axis X.

The first transmission device comprises the first housing gear 58, the tool gear 52 and the roller screw nut 50. The first electric motor 36 is adapted to spin the first drive shaft 56 which spins the first housing gear 58 which interacts with the tool gear 52. The first motor 36 produces a linear motion as long as the second motor 38 is holding its position. The maximal speed of the first motor is for instance 70 mm/s.

In an embodiment (not represented), an interface gear may be provided in the second housing portion and may be connected to the first housing gear. The interface gear may interact with the housing gear and the tool gear.

The second transmission device comprises the second housing gear 62 and the shaft gear 48 with anti-rotation sleeve. The spinning of the second drive shaft 60 leads to the spinning of the second housing gear 62 which interacts with the shaft gear 48 allowing translation and rotation of said shaft gear 48. The shaft gear 48 transfers a motion to the solid roller screw 40. In other words, the second motor 38 produces linear and rotational motion. The maximal speed is for instance 78 mm/s.

When both motors (first electric motor 36 and second electric motor 38) spin together at specified, but different speeds (more particularly, when the first drive shaft and the second drive shaft spin together at specified, but different speeds), the solid roller screw 40 is driven in translational and rotational movement. Thus, the solid roller screw 40 can transfer the translation and the rotation to the screw tool which can engage the internal thread of a blind fastener. For instance, the screw tool can translate in a first and in a second direction, opposite the first direction. Besides, the screw tool 34 can rotate in a first rotational direction and in a second rotational direction.

When the second electric motor 38 (or more precisely when the second drive shaft) is prevented from spinning and the first electric motor 36 (or the first drive shaft) spins, a linear motion of the solid roller screw is created. The linear motion may be in a first or in a second direction, opposite the first direction.

Feeder

The feeder comprises a fastener delivery tube 66 and a blind fastener supply (not represented), the delivery tube 66 being connected at a first end to the blind fastener supply and at a second end to the tool housing portion 26 for delivering the blind fastener in the tool housing portion 26. An isolated blind fastener 20 is directly delivered in the tool housing portion 26 in front of the screw tool 34 such that the setting step can directly be undertaken.

The delivery tube 66 may extend parallel or sensibly parallel to the tool housing portion 26. The delivery tube 66 merges with the tool housing portion 26 through a receiver assembly 68, the receiver assembly 68 comprising an interface channel 70 connecting directly the delivery tube 66 with the tool housing portion 26, such that the screw tool 40 can engage with a blind fastener 20 within the tool housing portion 26. The interface channel comprises a first portion 72 which is coaxial with the delivery tube 66 and a portion 74 which is coaxial with the longitudinal axis, such that the interface channel 70 is adapted to deliver the blind fastener within the tool housing portion and coaxially to the screw tool 34. A cover is used to close the interface channel 70.

The receiver assembly 68, and more particularly the interface channel, notably on its first portion, is provided with a stop function. A gate or a lever is arranged in the interface channel and is adapted to slow down the blind fastener 20 before its arrival in the tool housing portion. The gate or lever is in particular arranged in the first portion. Said gate or lever stops the blind fastener in the first portion until a signal is sent that a setting step is needed, and no other blind fastener is present in the tool housing portion. The gate or lever also prevents an unwanted falling of the blind fastener into the tool housing portion.

Figure 4:
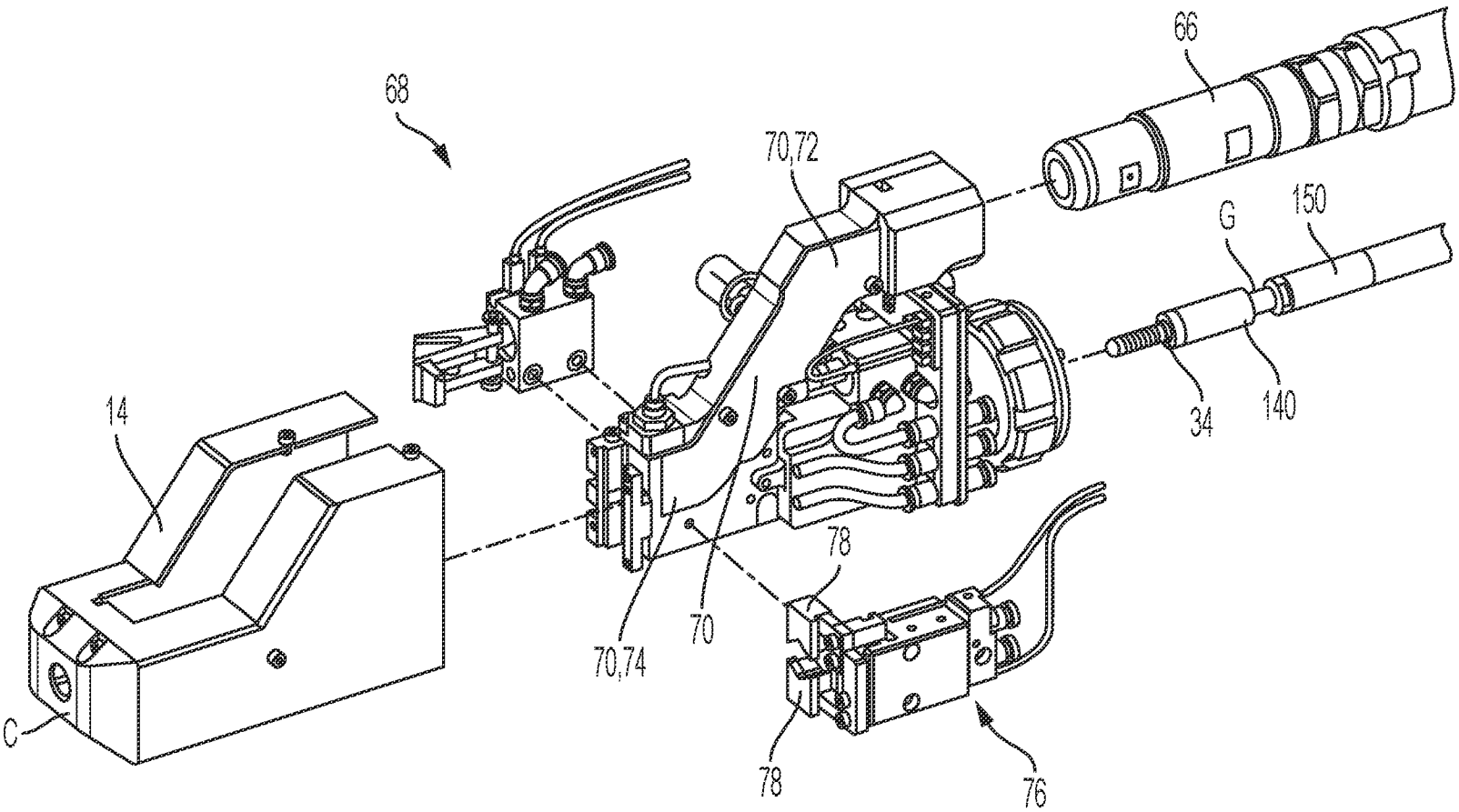
FIG. 4 shows a perspective view of the front of a tool housing portion of a setting tool according to the invention.
Figure 5C:
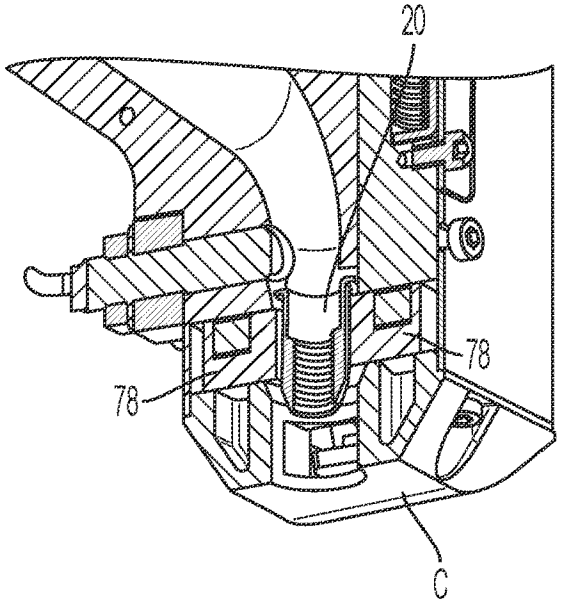
FIG. 5A to FIG. 5C show a view of a clamping device provided in the tool housing portion with a retaining tongue according to an embodiment.
Figure 5B:
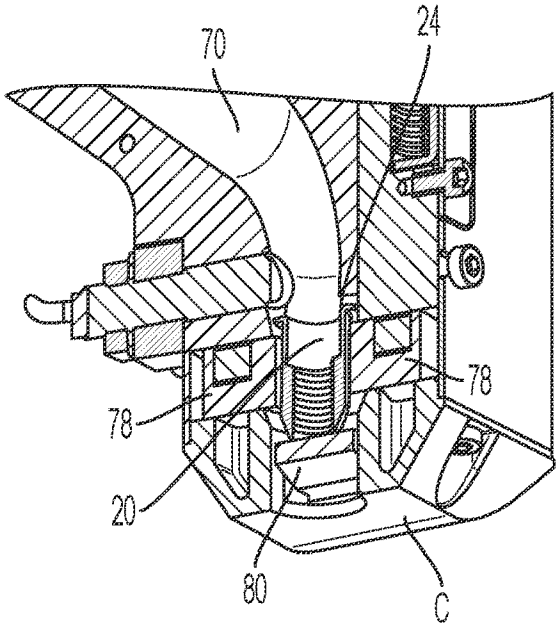
Figure 5A:
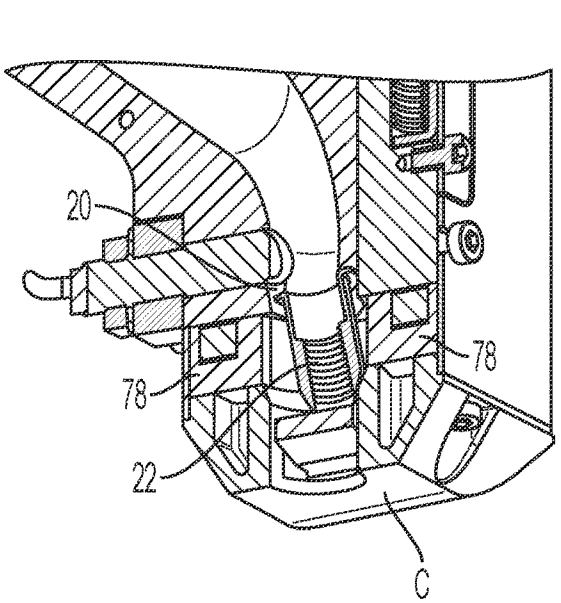

A clamping device 76 adapted to clamp a blind fastener 20 prior its engagement to the screw tool is provided, as illustrated in FIG. 4, FIG. FIG. 5B and FIG. 5C. The clamping device 76 is arranged in the receiver 68, and more particularly in the portion of the interface channel which is coaxial to the screw tool.

Figures 8A, 8B, 8C:
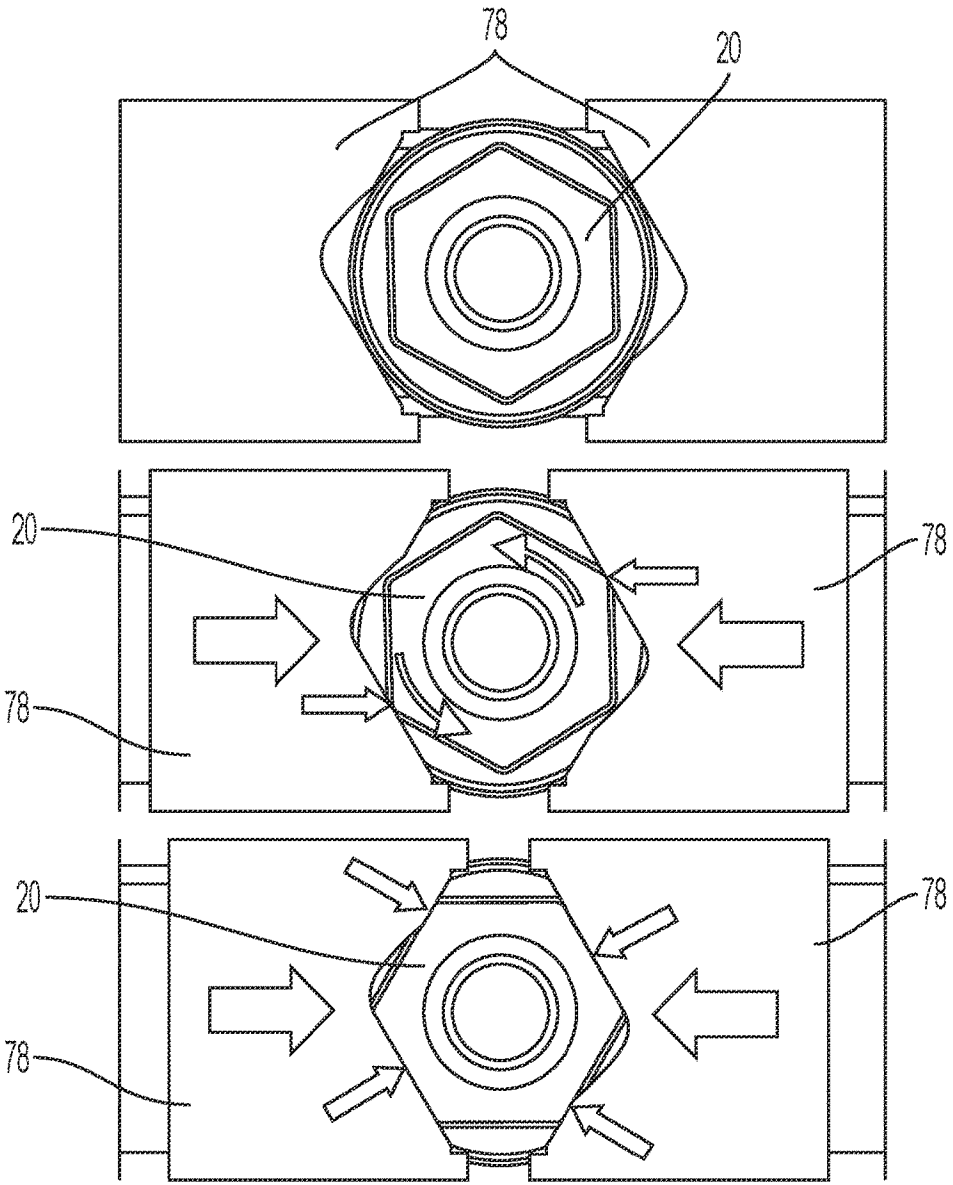
FIG. 8A to FIG. 8C show a detailed view of the clamping device of FIG. 5A to FIG. 5C with a blind fastener in three different positions.

The clamping device 76 comprises two jaws 78 movable between an open position and a clamped position, as depicted in FIG. 5A, FIG. 5B, FIG. 5C and FIG. 8A to FIG. 8C, which represent a preferred embodiment. The jaws 78 can be identical or symmetrical. Each jaw may comprise a curved portion adapted to face and clamp the blind fastener, and more particularly the shank of the blind fastener. As depicted in FIG. 8A to FIG. 8C, each jaw has a contour formed by two segments. The two segments form an angle with each other. The segments are both sensibly flat, but on one of the segments, a bump is provided. The bump of the first jaw may face the bump of the second jaw. Such design is particularly advantageous for hexagonal-shaped blind fasteners (or in other words blind elements with a hexagonal-shaped shank). Indeed, an unsymmetrical prism-shape supports the blind fastener to rotate before clamping and prevent a closing of the prism face on the edge of the hexagonal-shaped shank of the blind element. The jaws 78 slide such as to apply a retaining force on the blind fastener. For instance, the jaws are driven by an actuator which controls the open and closed position of the jaws 78. The arrows in FIG. 8A to 8C show the movement of the jaws and how the blind element may rotate to reach its final stable position.

Figure 7B:
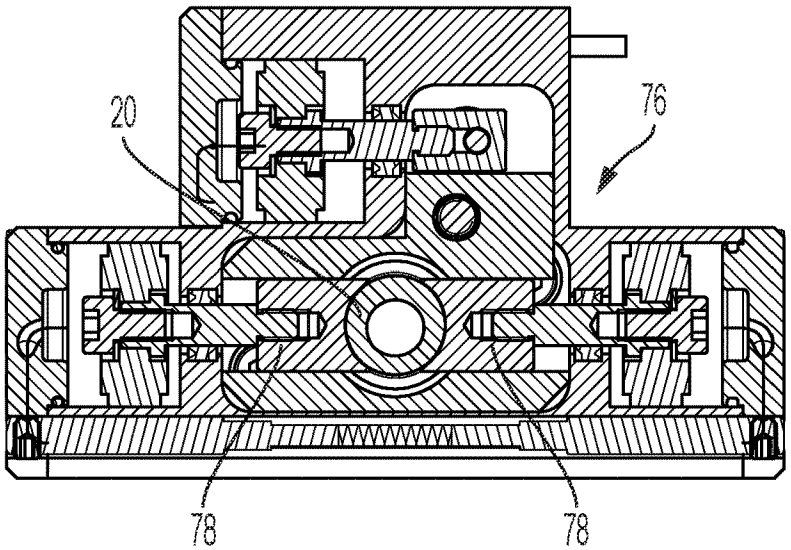
FIG. 7A and FIG. 7B shows a detailed view of the clamping device of FIG. 6A to FIG. 6C in two different positions.
Figure 7A:
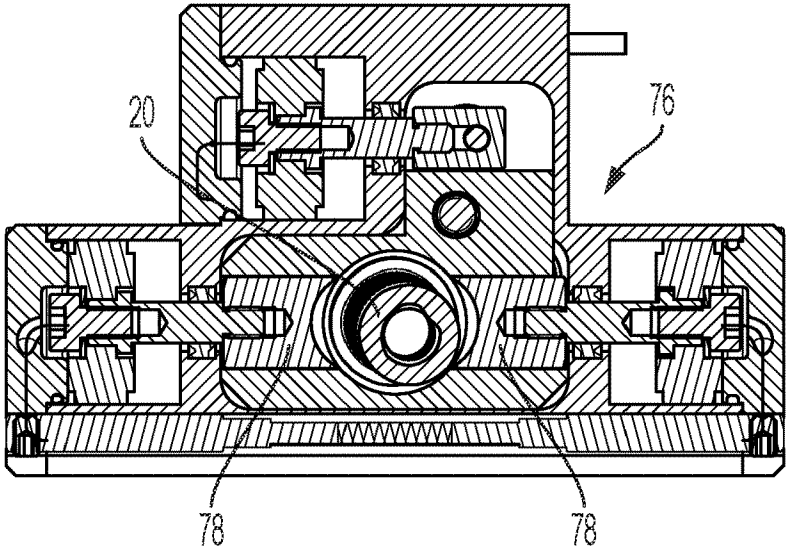

The jaws 78 may be off-centered with regard to the median axis of the blind fastener shank, such that a jaw grips the shank above the median axis, and the other jaw grips the shank below the median axis, in an embodiment as represented in FIG. 7A and FIG. 7B. In FIG. 8A, the jaws 78 are open. In FIG. 8C the jaws 78 are closed and the blind fastener is aligned along the longitudinal axis X. The jaws 78 may be arranged such as to create an eccentric clamping movement. Thus, the blind fastener 20 can be adapted to the contour of the jaws 78 and can slide or move into the desired clamping position. This is particularly useful for nuts with hexagonal cross-section profiles.

Figure 6B:
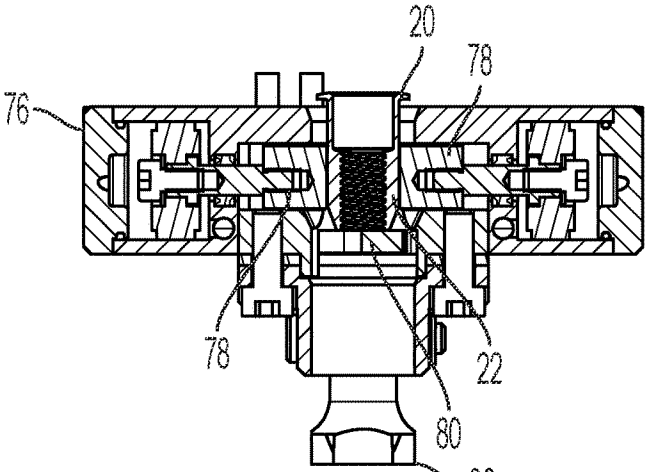
FIG. 6A to FIG. 6C show a view of a clamping device provided in the tool housing portion with a retaining lever according to another embodiment.
Figure 6A:
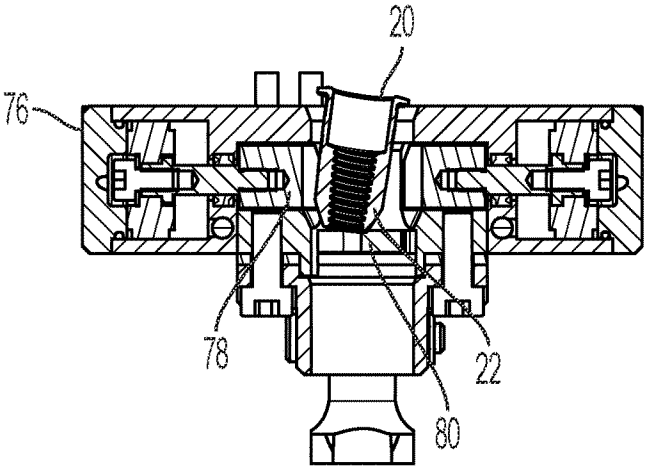
Figure 6C:
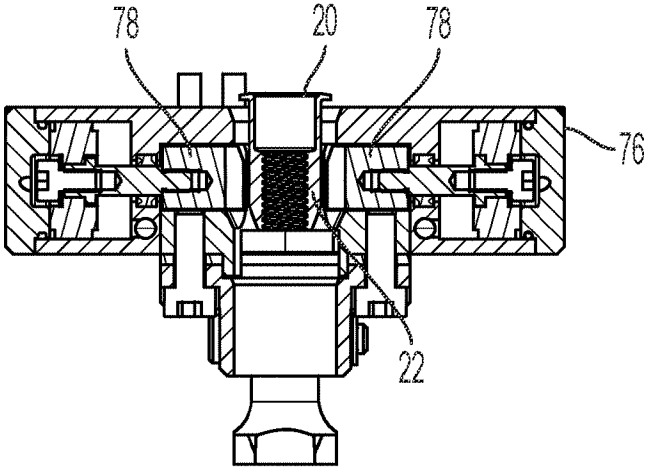
Figure 9B:
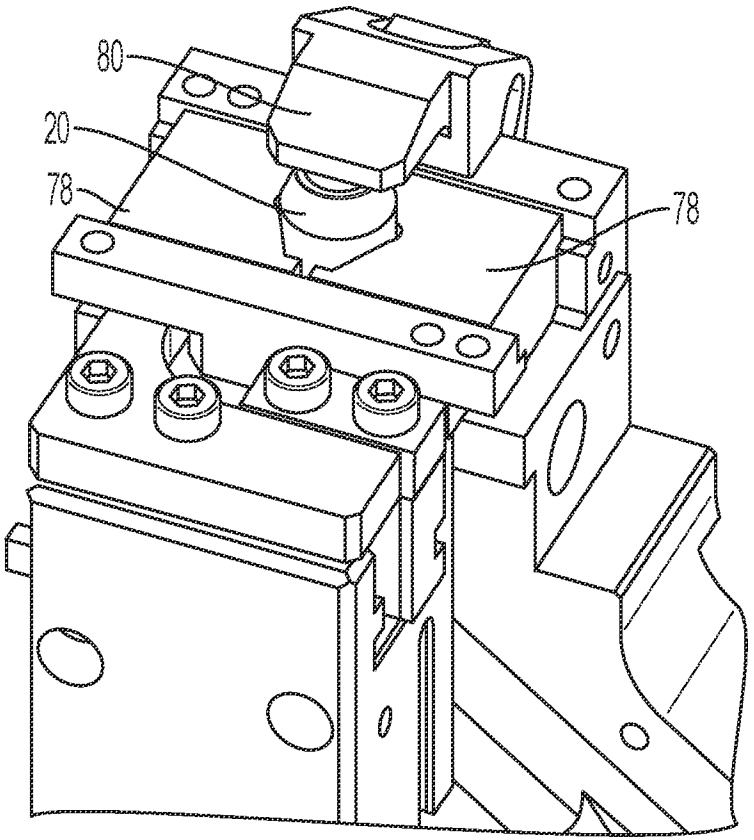
FIG. 9A and FIG. 9B is a detailed view of the retaining tongue of FIG. 5A and FIG. 5B.
Figure 9A:
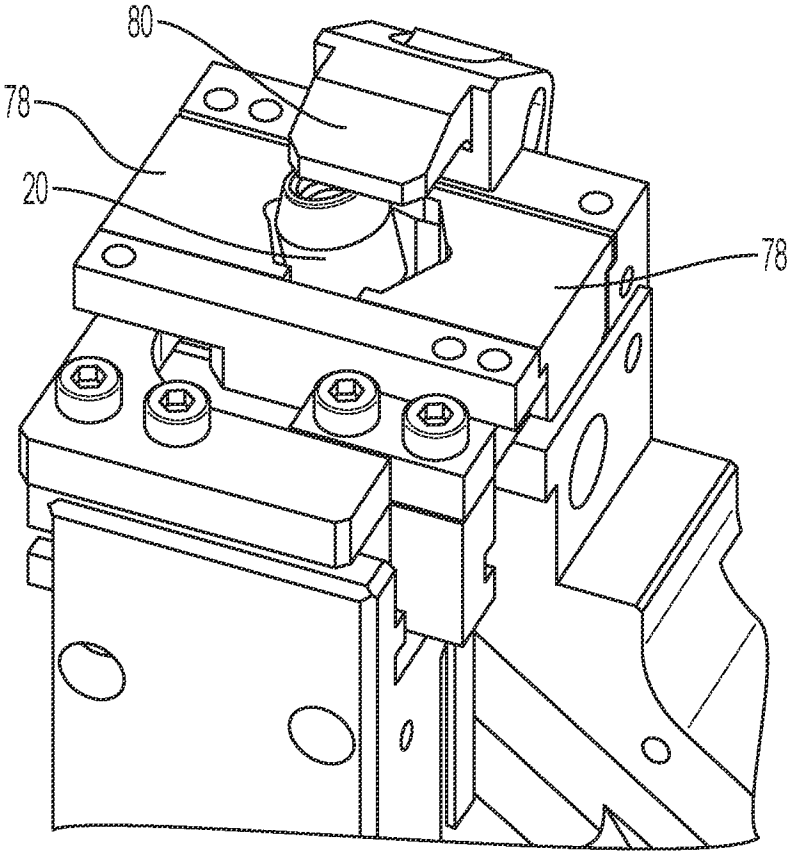

The clamping device 76 may further comprises a retaining lever 80 in an embodiment shown in FIG. 6A, FIG. 6B and FIG. 6C or in a preferred embodiment shown in FIG. 9A and FIG. 9B. The retaining lever retains the blind fastener in the clamping device during the clamping by the jaws. The retaining lever 80 is more particularly described in FIG. 6A to FIG. 6C, or in FIGS. 9A and 9B. In FIG. 6A or 9A or 9B, the retaining lever closes the interface channel and the jaws are open. Thus, the blind fastener can take place in the receiver in the portion of the interface channel which is coaxial to the screw tool and the blind fastener cannot fall further. Then, the jaws 78 close, as depicted in FIG. 6B and the retaining lever 80 still closes the interface channel 70. The blind fastener, which is maintained by the jaws, is then ready for engagement with the screw tool 34.

An elastic element or spring S may be arranged beyond the screw tool, more particularly between the screw tool and the tool shaft (see FIG. 2 or FIG. 3). The tool shaft 32 may have a recess provided at the free end of its rear segment and the spring is received partially in this recess. The elastic element S ensures an axial compensation when the blind fastener is in the clamping device for the engagement with the screw tool. Indeed, depending on the blind fastener, its internal thread or its position in the clamping device, a compensation along a longitudinal axis may be necessary. Thus, a spring-loaded mandrel is formed.

Finally, once the engagement with the screw tool is done, the retaining lever open the interface channel and the jaws open. The blind fastener, which is now engaged with the screw tool is ready for the setting step into the workpiece.

Nose

In a preferred embodiment, a sensor is provided at the front end of the device. For example, a radar sensor or an image sensor may be provided. Thus, the exact position of the hole is known, and a tolerance compensation is either not necessary or allows a compensation of the hole localisation when needed.

Figure 10B:
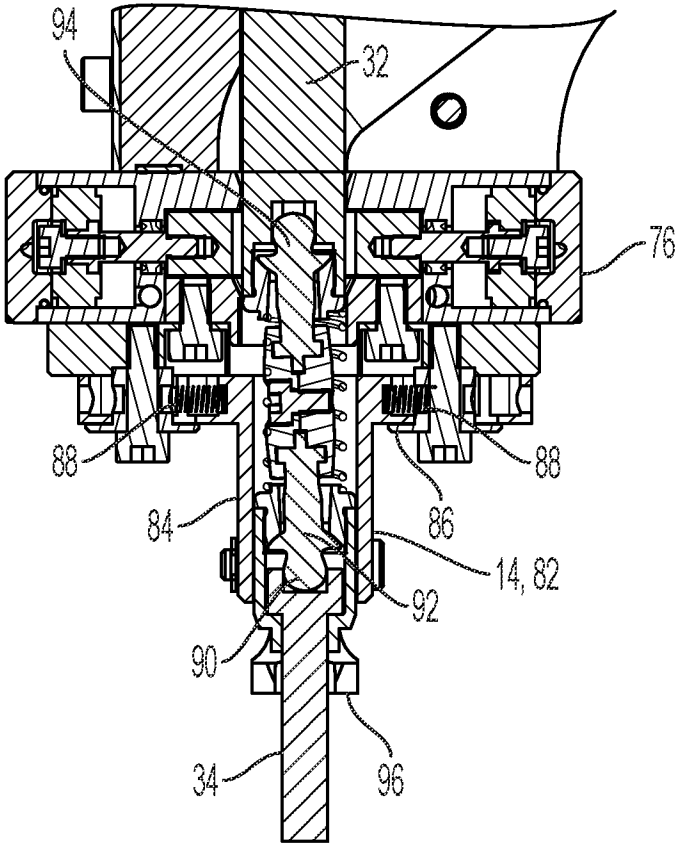
FIG. 10B shows a sectional view of the front of a tool housing portion movably connected to a nose in a second position according to the embodiment of FIG. 10A.
Figure 10A:
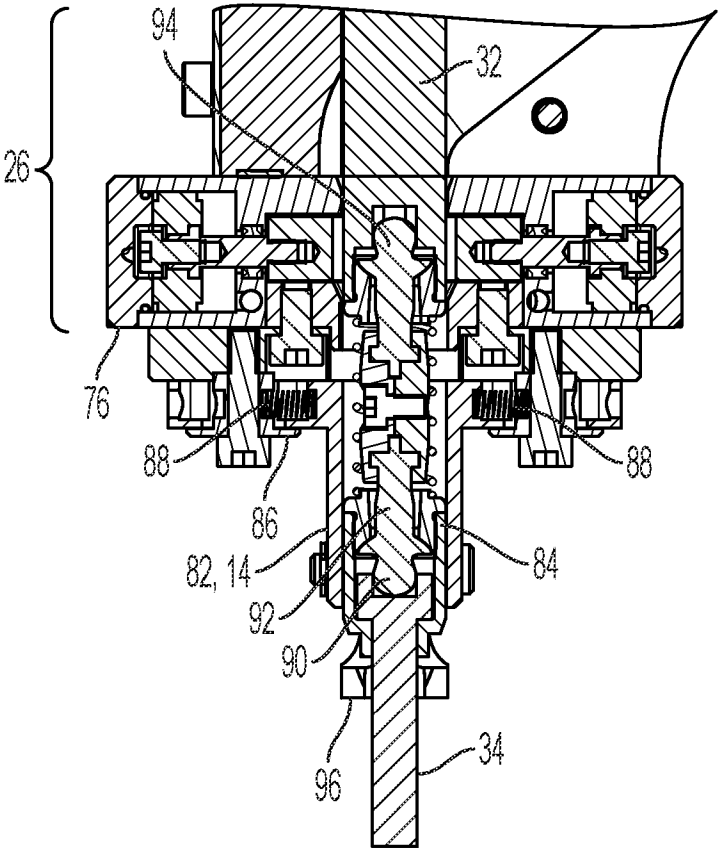
FIG. 10A shows a sectional view of front of a tool housing portion according to an embodiment, the front of the tool housing portion in this embodiment being movably connected to a nose in a first position.

In a particular embodiment, as illustrated in FIG. 10A and FIG. 10B, a nose 82 is provided at an end of the tool housing portion 26. The blind fastener 20 is adapted to emerge through the nose 82 and to be guided in a hole of a workpiece by the nose 82. The nose 82 comprises a cylindrical housing 84 in which the blind fastener can be driven by the drive shaft and the screw tool 34. The screw tool 34 can extend in the cylindrical housing 84 and slide into said cylindrical housing 84. The nose 82 may comprise a self-centering device 86, such that the nose is slidably mounted to the tool housing portion. Such self-centering device allows to compensate tolerances when introducing the blind fastener 20 into a hole of a workpiece. Indeed, even if the position of the holes is known before the setting steps, such that the setting tool knows where to introduce the blind fastener, manufacturing tolerances always appear. For instance, the self-centering device 86 may comprise two centering rods and three springs 88 arranged in three different directions of the cylindrical housing 84 allowing the nose 82 to move and centre after the crimping step. The springs allow an elastic return of the nose 82 in its rest position. The screw tool 34 may be connected to the tool shaft through a ball joint connection 90, as visible in FIG. 10A and FIG. 10B. For instance, a centering shaft 92 with two ball joints connection 90, 94 at each end is arranged between the screw tool 34 and the tool shaft 32. The first ball joint connection is provided between the centering shaft and the screw tool 34, whereas the second ball joint connection is provided between the centering shaft 92 and the tool shaft 32. This allows a correct centering of the blind fastener with regard to the hole. In FIG. 10A, the nose is centered. In FIG. 10B, the nose is eccentric. Thus, a tolerance compensation during hole finding when the blind fastener 20 is inserted into a hole of a workpiece may be realized.

In the preferred embodiment, the radar sensor allows finding of the hole and no tolerance compensation is needed.

Method

A blind fastener 20 can be set in a hole of a workpiece with the above-described setting tool as follow.

In a first step, a blind fastener is fed through the feeder with the delivery tube. The blind fastener 20 is for instance fed with compressed air. The blind fastener then reaches the receiver assembly 68 and is maintained in the clamping device 76 by the retaining lever. The jaws grip the blind fastener.

Both motors spin together at specified but different speeds to move the screw tool such that it engages with the internal thread of the blind fastener 20.

The blind fastener engaged with the screw tool 34 is then driven through the tool housing portion and outside a cap C forming the front end of the housing portion of the device. More particularly, the cap C is arranged at a free end of the tool nose 14. A sleeve anvil 140 is provided on the screw tool and the screw tool 34 with the blind element is translated until the jaws close in a recess G arranged before the anvil sleeve on the screw tool 34. The screw tool 34 moves then backwards such that the anvil sleeve 140 contacts the closed jaw 78. The nut is now ready to be set in a hole.

The entire assembly is driven such that the blind fastener is inserted into a hole of a workpiece by the arm of a robot. For instance, the arm of the robot can move the entire setting tool 10.

Once the head of the blind element sits on the surface of the workpiece and the shank is arranged in the hole, the second motor 38 is prevented from spinning, the first motor 36 is allowed to spin to create linear motion of the solid roller screw and the screw tool in a second direction opposite the direction of the hole. A portion of the screw tool 34 moves backward within the setting tool, and thus, a portion of the blind fastener collapses (the head of the blind fastener resting against the anvil sleeve which does not move during the crimping step). For example, the load may be up to 30 or 35 kilo-Newtons. The tool shaft and the screw tool move during the crimping step to allows the formation of the bulge in the shank of the blind fastener and the tool housing portion remain at the same place. The screw tool, tool shaft and solid roller screw slides within the tool housing portion. Eventually a torque test for checking the crimping function may be undertaken.

Once the crimping step is done and the jaws open, the anvil sleeve is retracted by its pressure spring inside, and both motors spin together at specified but different speeds to move the screw tool 34 to disengage with the collapsed blind fastener. A torque on and off test for checking the thread may be undertaken.

The torque surveillance may be realized by the second motor. If the torque is too high compared to a reference point or a reference curve, then an alarm might appear during the setting process, for instance when threading onto the blind element or threading off the blind element, highlighting a misfunction. The torque can thus be monitored during the entire setting process.

The roller screw and the screw tool move back until the feeding channel is released for the next feed.

Figure 14A:
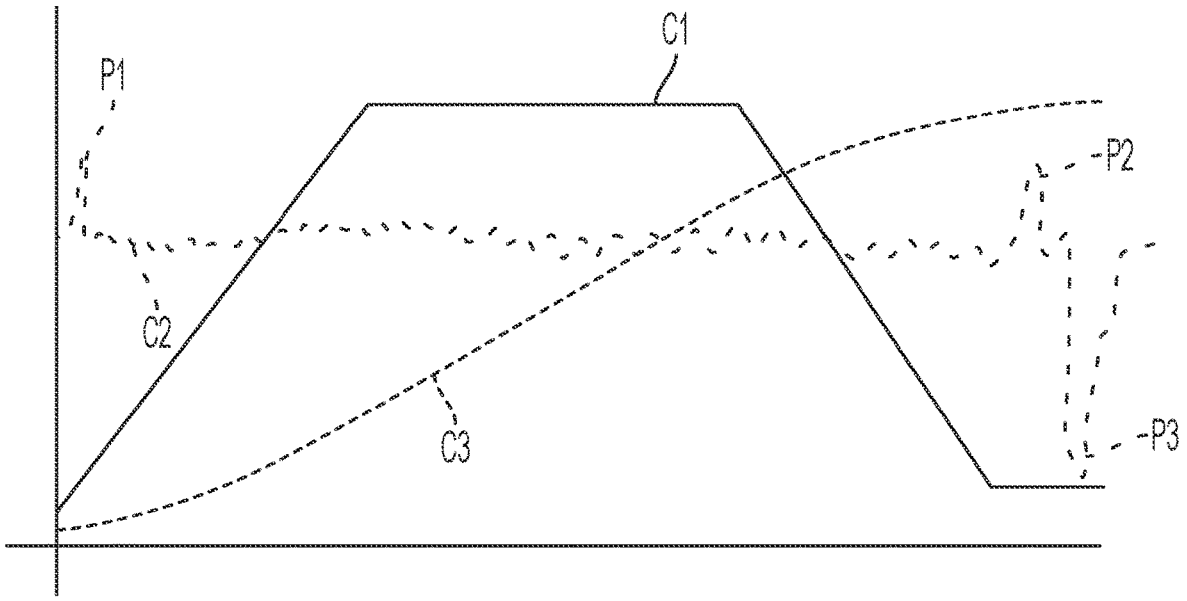
FIG. 14A schematically shows the torque, speed and angle recorded during a setting step of a first motor with a second motor holding its position.
Figure 14B:
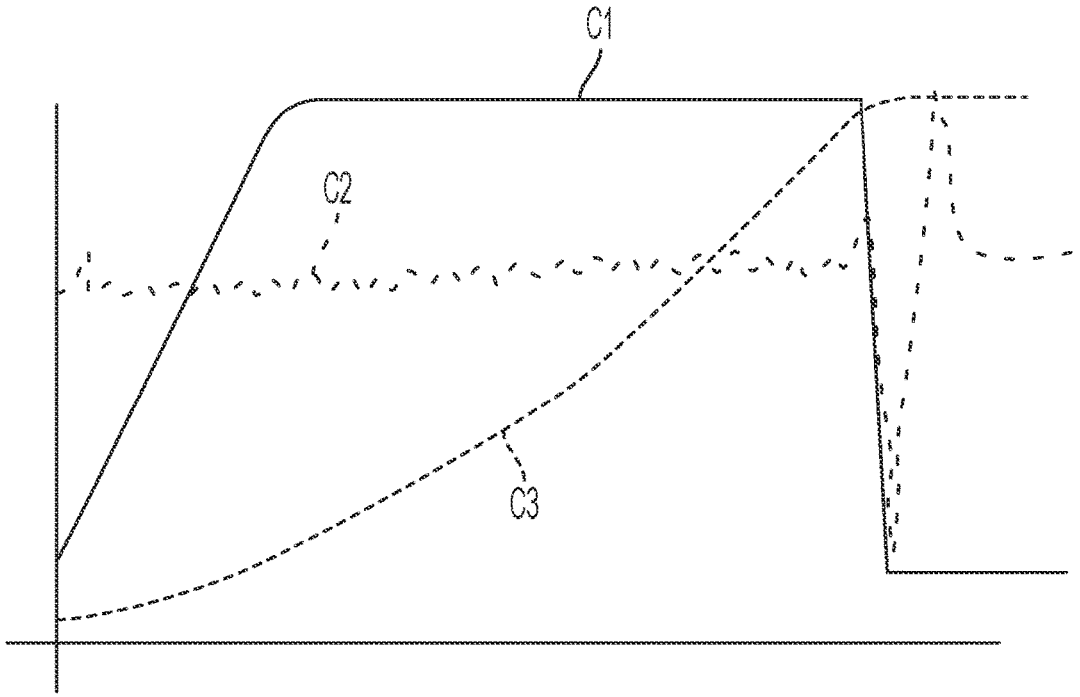
FIG. 14B shows the torque, speed and angle recorded during a setting step of the first motor according a second movement strategy.

FIG. 14A and FIG. 14B show curves with the speed, the torque and the angle of the first motor which are sensibly correlated to roller screw values since the second motor holds its position and therefore the speed of the roller screw corresponds more or less to the speed of the first motor, the position of the roller screw corresponds more or less to the position of the first motor. The first and the second motors 36, 38 both have a motor resolver which provides the local position of the motor every moment without considering if the motor is moving or not. Based on gear calculations, it is thus possible to know the linear and angular position of the roller screw 40 in every moment. Both motors are also provided with a torque transducer for measuring and recording the torque. An increase of torque observed on the roller screw 40 may correspond to acceleration and counterforces generated by mechanical components: gears, their masses, fastening process, etc.

FIG. 14A shows the speed, the torque and the angle of the first motor. C1 represents the speed of the first motor, C2 represents the torque and C3 represents the angle. The curve represents the system when the first motor 36 is working and the second motor 38 holds its position. P1, P2 and P3 are torque peaks, which should normally be avoided, in order to reduce wearing. More particularly, the first peak P1 is due to acceleration and start moving masses. The second and third peaks P2 and P3 are due to the sudden stop of the first motor 36 when the setting process need to stop a movement or when a new step of the setting process requiring the stop of the motor is engaged. In order to limit the peaks P2 and P3, it is aimed to make the speed curve C1 total symmetric where deceleration goes down till zero and there's no hard stop.

FIG. 14B shows the speed, the torque and the angle of the first motor when the position of the second motors is dynamically hold. The torque force produced by stopping the first motor 36 is released through the second motor 38, such that no torque peak is produced, and the roller screw is correctly stopped, as desired. Indeed, the roller screw 40 is stopped by the mechanical counterpart that has generated the torque peak and the friction force of the system. This allows an increase of the gears life by minimizing the torque peak.

A similar strategy may also be used if an unexpected torque is monitored during the normal use of the tool. Indeed, if the system monitors an abnormal high torque, a controller can stop the first motor and released the second motor, such as to avoid a torque peak which would occur if the first motor 36 is stopped alone.

The tool nose 14 comprises an anvil sleeve which acts as a stop for the crimping operation. The roller screw moves the load pin assembly in a position where the clamping jaws close. When the load pin assembly is moved backwards, the anvil sleeve touches the clamping jaws with a defined force (detected by load cell and/or torque transducer). The nut is now prepared, and the tool can be moved forward with the nut into the hole/opening of the sheet. Once the shoulder of the nut sits on top of the sheet (detected by a displacement transducer inside the tool) the crimping process starts. For this purpose, the roller screw and thus the load pin assembly move backward inside the tool to a specific force and distance. Thereby the screw tool 34 moves relative to the anvil sleeve which is prevented to move by the clamping jaws. The mandrel crimps the nut and form a bulge on the backside of the hole/opening. After the crimping process the clamping jaws open and the anvil sleeve is retracted by its pressure spring inside. The roller screw and thus the load pin assembly unscrew the screw tool 34 and move back until the feeding channel is released for the next feed.

Although exemplary embodiments of the present invention have been shown and described, it will be appreciated by those skilled in the art that changes may be made to these embodiments without departing from the principles and spirit of the invention, the scope of which is defined in the appended claims and their equivalents.

What is claimed is:

1. A method for setting a blind fastener to a workpiece, the method for setting comprising the steps of:

providing the workpiece partially defining a through hole, providing the blind fastener comprising a head and a shank partially defining an axial bore including a female thread, providing a setting tool comprising:

a tool housing;

a screw tool including a male thread is rotationally and translationally movable within the housing along and around a tool axis between a retracted position and an extended position;

a first electric motor with a first drive shaft axially fixed to the tool housing, and operable to drive a first transmission, the first drive shaft defining a first axis parallel to but radially spaced from the tool axis;

a second electric motor with a second drive shaft axially fixed to the tool housing, and operable to drive a second transmission, the second drive shaft defining a second axis parallel to but radially spaced from the tool axis and from the first axis; and a solid roller screw arranged for rotation and axial movement in the tool housing and drivably connected to the first electric motor via the first transmission, and drivably connected to the second electric motor via the second transmission, and the solid roller screw is axially concentric with and in driving connection to the screw tool;

supplying the blind fastener to the setting tool and delivering the blind fastener in the tool housing in front of the screw tool when the screw tool is in the retracted position;

engaging the screw tool with the blind fastener within the tool housing; and setting the blind fastener to the workpiece.

2. The method for setting a blind fastener to a workpiece according to claim 1, wherein the step of providing the setting tool, the setting tool further comprises: a feeder including a fastener delivery tube, the fastener delivery tube connected at a first end to a blind fastener supply and at a second end to the tool housing, and the fastener delivery tube merges with the tool housing through a receiver assembly, the receiver assembly including an interface channel connecting directly the delivery tube with the tool housing; and the step of supplying the blind fastener to the setting tool further comprises: feeding the blind fastener through the feeder, such that the blind fastener moves through the fastener delivery tube to the receiver assembly.

3. The method for setting a blind fastener to a workpiece according to claim 2, wherein the step of supplying the blind fastener to the setting tool further comprises: retaining the blind fastener in the receiver assembly such that the blind fastener is in a loading position.

4. The method for setting a blind fastener to a workpiece according to claim 1, wherein the step of engaging the screw tool further comprises:

guiding the screw tool with the first transmission and the second transmission in a first direction along the tool axis into the axial bore of the blind fastener and threading the screw tool into the female thread of the blind fastener.

5. The method for setting a blind fastener to a workpiece according to claim 4, wherein the step of engaging the screw tool further comprises:

spinning of the first drive shaft at a first speed and spinning the second drive shaft at a second speed different from the first speed; and driving the screw tool in both a linear movement and a rotational movement.

6. The method for setting a blind fastener to a workpiece according to claim 1, wherein the step of setting the blind fastener further comprises:

driving the blind fastener further in a first direction along the tool axis to a position outside the tool housing; and guiding the blind fastener into the through hole until the head contacts the workpiece surrounding the through hole and the shank extends beyond the through hole.

7. The method for setting a blind fastener to a workpiece according to claim 6, wherein the step of setting the blind fastener further comprises:

deforming the blind fastener through a displacement by the first transmission in a second direction, opposite to the first direction, and thereby crimping the blind fastener to the workpiece.

8. The method for setting a blind fastener to a workpiece according to claim 7, wherein the step of setting the blind fastener further comprises:

resting the head of the blind fastener against the setting tool which does not move during the crimping step holding the second electric motor to prevent rotation of the second transmission spinning the first electric motor to create linear motion of the roller screw and the screw tool in the second direction;

moving the screw tool backward within the tool housing, collapsing a portion of the shank and crimping the workpiece between a bulge in the shank and the head.

9. The method for setting a blind fastener to a workpiece according to claim 1 and further comprising:

disengaging the screw tool from the blind fastener by driving the screw tool with the first transmission and the second transmission in both rotation and away from the workpiece.

* * * * *